US011787656B2

(12) United States Patent
Fujiwara et al.

(10) Patent No.: US 11,787,656 B2
(45) Date of Patent: Oct. 17, 2023

(54) IMAGE FORMING APPARATUS

(71) Applicant: Brother Kogyo Kabushiki Kaisha, Nagoya (JP)

(72) Inventors: Takashi Fujiwara, Nagakute (JP); Yuji Takimoto, Handa (JP); Shota Shinoya, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/994,925

(22) Filed: Aug. 17, 2020

(65) Prior Publication Data

US 2021/0061608 A1 Mar. 4, 2021

(30) Foreign Application Priority Data

Aug. 30, 2019 (JP) ..... 2019-158620

(51) Int. Cl.

*B65H 31/00* (2006.01)
*B65H 31/02* (2006.01)
*G03G 15/00* (2006.01)

(52) U.S. Cl.

CPC ..... *B65H 31/00* (2013.01); *B65H 2402/30* (2013.01); *B65H 2402/44* (2013.01); *B65H 2551/21* (2013.01); *G03G 15/6552* (2013.01)

(58) Field of Classification Search

CPC .... B65H 31/00; B65H 31/02; B65H 2551/21; B65H 2551/18; B65H 2402/34;

(Continued)

(56) References Cited

U.S. PATENT DOCUMENTS 7,276,670 B2 * 10/2007 Kobayashi ..... H04N 1/0035 200/5 A
9,513,589 B2 12/2016 Arimura (Continued)

FOREIGN PATENT DOCUMENTS

CN 101231485 A 7/2008
CN 101833260 A 9/2010

(Continued)

OTHER PUBLICATIONS

Japanese Office Action (with English translation) dated Mar. 28, 2023 (Application No. 2019-158620).

(Continued)

*Primary Examiner* — Luis A Gonzalez
(74) *Attorney, Agent, or Firm* — BURR PATENT LAW, PLLC

(57) ABSTRACT

An image forming apparatus includes a discharging tray for supporting a sheet, an operation panel and a supporting member. The sheet is discharged toward a sheet discharging direction that is a direction toward which the sheet is discharged. The operation panel is located at a position which is different from the position of the discharging tray in a width direction orthogonal to the sheet discharging direction and above the discharging tray. The supporting member is disposed at the discharging tray and capable of supporting the discharged sheet with the discharging tray. A front end portion of the supporting member is located above an upper surface of the discharging tray. At least a part of the front end portion of the supporting member overlaps the operation panel when viewed in the width direction.

21 Claims, 7 Drawing Sheets

(58) Field of Classification Search
CPC ..... B65H 2402/44; B65H 2405/11151; B65H 2405/1116; B65H 2405/11162; B65H 2405/1111; B65H 2405/1124; G03G 15/5016; H04N 1/00493; H04N 1/00496
See application file for complete search history.

(56) References Cited

U.S. PATENT DOCUMENTS

| | | | | |
|---|---|---|---|---|
| 9,817,351 | B2 * | 11/2017 | Yamada | H04N 1/00384 |
| 2007/0297818 | A1 * | 12/2007 | Yamada | G03G 15/5016 399/38 |
| 2008/0175640 | A1 | 7/2008 | Akiyama | |
| 2010/0232857 | A1 | 9/2010 | Nakayama | |
| 2011/0305465 | A1 | 12/2011 | Mimura | |
| 2012/0243042 | A1 | 9/2012 | Uchida | |
| 2014/0369713 | A1 * | 12/2014 | Nakao | G03G 21/1633 399/107 |
| 2016/0009519 | A1 | 1/2016 | Kishi et al. | |
| 2016/0054696 | A1 | 2/2016 | Toda | |
| 2016/0147189 | A1 * | 5/2016 | Arimura | B65H 31/02 271/213 |
| 2017/0102660 | A1 * | 4/2017 | Maruta | G03G 15/6552 |
| 2017/0219976 | A1 | 8/2017 | Ito et al. | |
| 2017/0371285 | A1 * | 12/2017 | Tanaka | B65H 43/00 |
| 2018/0284684 | A1 * | 10/2018 | Nakai | G03G 21/1619 |
| 2019/0003222 | A1 * | 1/2019 | Taguchi | G03G 15/6552 |
| 2019/0364164 | A1 * | 11/2019 | Katayama | H04N 1/00588 |
| 2020/0278632 | A1 * | 9/2020 | Mori | G03G 15/5016 |
| 2020/0285188 | A1 * | 9/2020 | Okamoto | G03G 21/1652 |
| 2021/0094781 | A1 * | 4/2021 | Yoshida | B65H 31/02 |

FOREIGN PATENT DOCUMENTS

| | | | |
|---|---|---|---|
| CN | 102281374 | A | 12/2011 |
| CN | 102694945 | A | 9/2012 |
| CN | 105253687 | A | 1/2016 |
| CN | 108696661 | A | 10/2018 |
| CN | 109218554 | A | 1/2019 |
| JP | 2007-246281 | A | 9/2007 |
| JP | 2008-135918 | A | 6/2008 |
| JP | 2008-207926 | A | 9/2008 |
| JP | 2010-105792 | A | 5/2010 |
| JP | 2010-208844 | A | 9/2010 |
| JP | 2012-101926 | A | 5/2012 |
| JP | 2016-044005 | A | 4/2016 |
| JP | 2016-098108 | A | 5/2016 |
| JP | 2016-139902 | A | 8/2016 |
| JP | 2017-134345 | A | 8/2017 |
| JP | 2018-172186 | A | 11/2018 |
| JP | 2019-144466 | A | 8/2019 |

OTHER PUBLICATIONS

Chinese Office Action (with English translation), Chinese Application No. 202010861429.5, dated Apr. 14, 2023 (11 pages).

* cited by examiner

IMAGE FORMING APPARATUS

CROSS-REFERENCE TO RELATED APPLICATION

This application claims priority from Japanese Patent Application No. 2019-158620 filed on Aug. 30, 2019, the content of which is incorporated herein by reference in its entirety.

TECHNICAL FIELD

The present disclosure relates to an image forming apparatus having an operation panel.

BACKGROUND

A known image forming apparatus (e.g., a laser printer) includes an operation panel, which may be disposed in various locations considering usability of the operation panel. One example of such image forming apparatus includes an operation panel disposed above a discharging tray, on which printed sheets are to be discharged.

SUMMARY

The operation panel disposed above the discharging tray may enhance accessibility to the operation panel. However, the operation panel above the discharging tray may be located over sheets discharged on the discharging tray. Thus, a user may need to put his/her hand into a small space between the operation panel and the discharged sheets to access the discharged sheets. It would be preferable that both the accessibility to the discharged sheets and the accessibility to the operation panel are sufficient.

An image forming apparatus disclosed herein may comprise: a discharging tray for supporting a sheet, the sheet being discharged toward a sheet discharging direction, the sheet discharging direction being a direction toward which the sheet is discharged; an operation panel locating at a position which is different from the position of the discharging tray in a width direction orthogonal to the sheet discharging direction and above the discharging tray; and a supporting member disposed at the discharging tray, the supporting member being capable of supporting the discharged sheet with the discharging tray, front end portion of the supporting member locating above a top surface of the discharging tray, wherein at least a part of the front end portion of the supporting member overlaps the operation panel when viewed in the width direction.

According to the above image forming apparatus, the user may access the discharged sheet on the discharging tray only by sliding his/her hand in the width direction after the user instructs printing by using the operation panel. Thus, both the accessibility to the operation panel and the accessibility to the discharged sheets on the discharging tray subsequent to the operation for the operation panel may be enhanced.

Another image forming apparatus disclosed herein may comprise: a discharging tray for supporting a sheet, the sheet being discharged toward a sheet discharging direction, the sheet discharging direction being a direction toward which the sheet is discharged; an operation panel locating at a position which is different from the position of the discharging tray in a width direction orthogonal to the sheet discharging direction and above the discharging tray, the operation panel including an operation screen; and a supporting member disposed at the discharging tray, the supporting member being capable of supporting the discharged sheet with the discharging tray, front end portion of the supporting member locating above a top surface of the discharging tray, wherein at least a part of the supporting member overlaps a rectangle area when viewed in the width direction, the operation screen in the operation panel consisting a diagonal line of the rectangle area.

According to the above image forming apparatus, the user may access the discharged sheet on the discharging tray only by sliding his/her hand in the width direction after the user instructs printing by using the operation panel. Thus, both the accessibility to the operation panel and the accessibility to the discharged sheets on the discharging tray subsequent to the operation for the operation panel may be enhanced.

DETAILED DESCRIPTION

Figure 1:
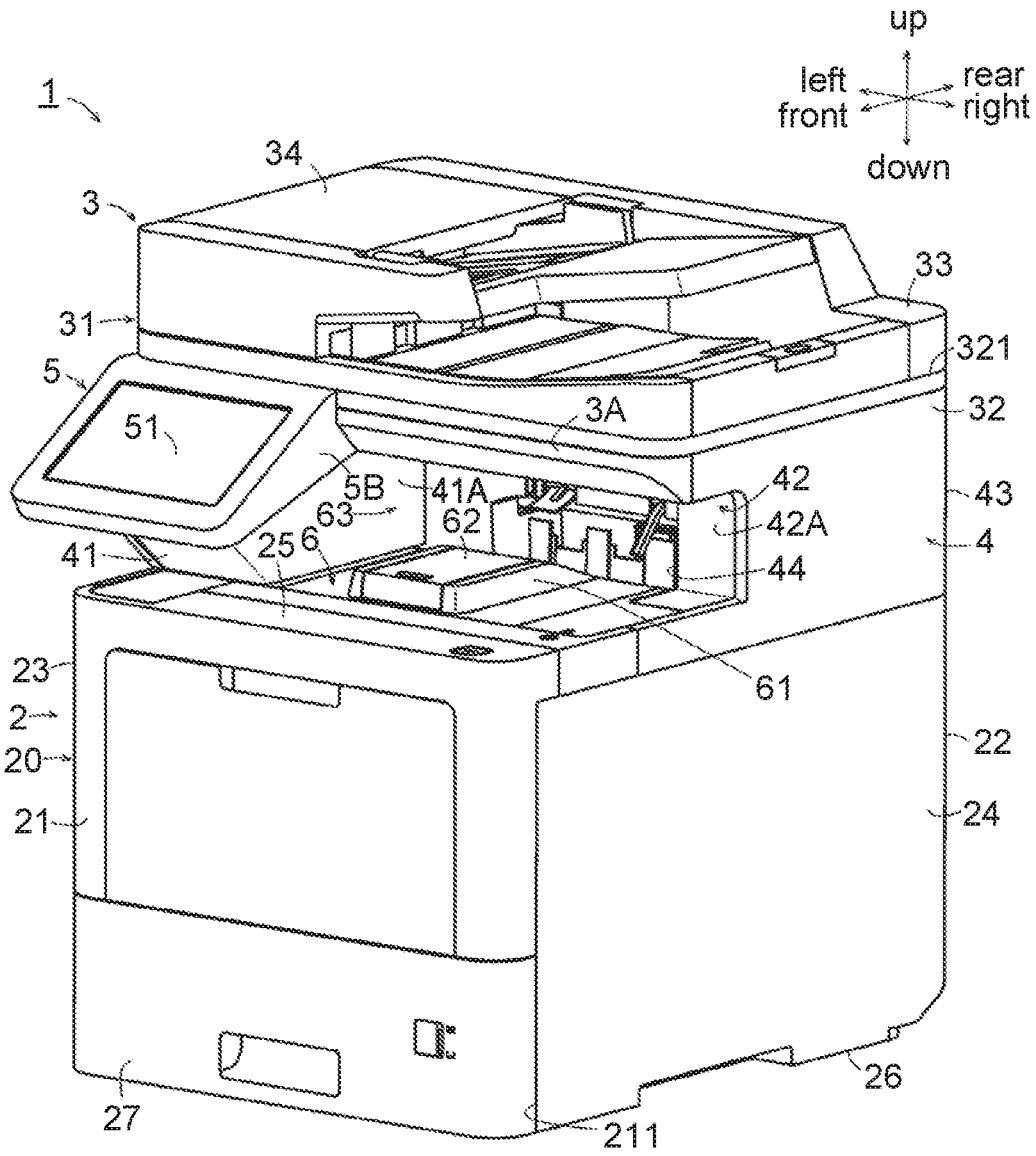
FIG. 1 is a perspective view of an image forming apparatus according to an illustrative embodiment of the disclosure.

Hereinafter, with reference to an orientation of the image forming apparatus 1 that may be disposed in which it may be intended to be used as illustrated in FIG. 1, the directions may be defined as follows: a side at which an operation panel is disposed is front, and the opposite side is rear; a direction when viewed from the front side of the image forming apparatus 1 is left-right direction; and a side of a second housing 3 of the image forming apparatus 1 is up, and side of a first housing 2 of the image forming apparatus is down. In this embodiment, a front side of the image forming apparatus 1 may be defined as a downstream side in a sheet discharging direction, and a rear side of the image forming apparatus 1 may be defined as an upstream side in the sheet discharging direction. The left-right direction is a width direction orthogonal to the sheet discharging direction.

[Overall Structure of Image Forming Apparatus]

Figure 2:
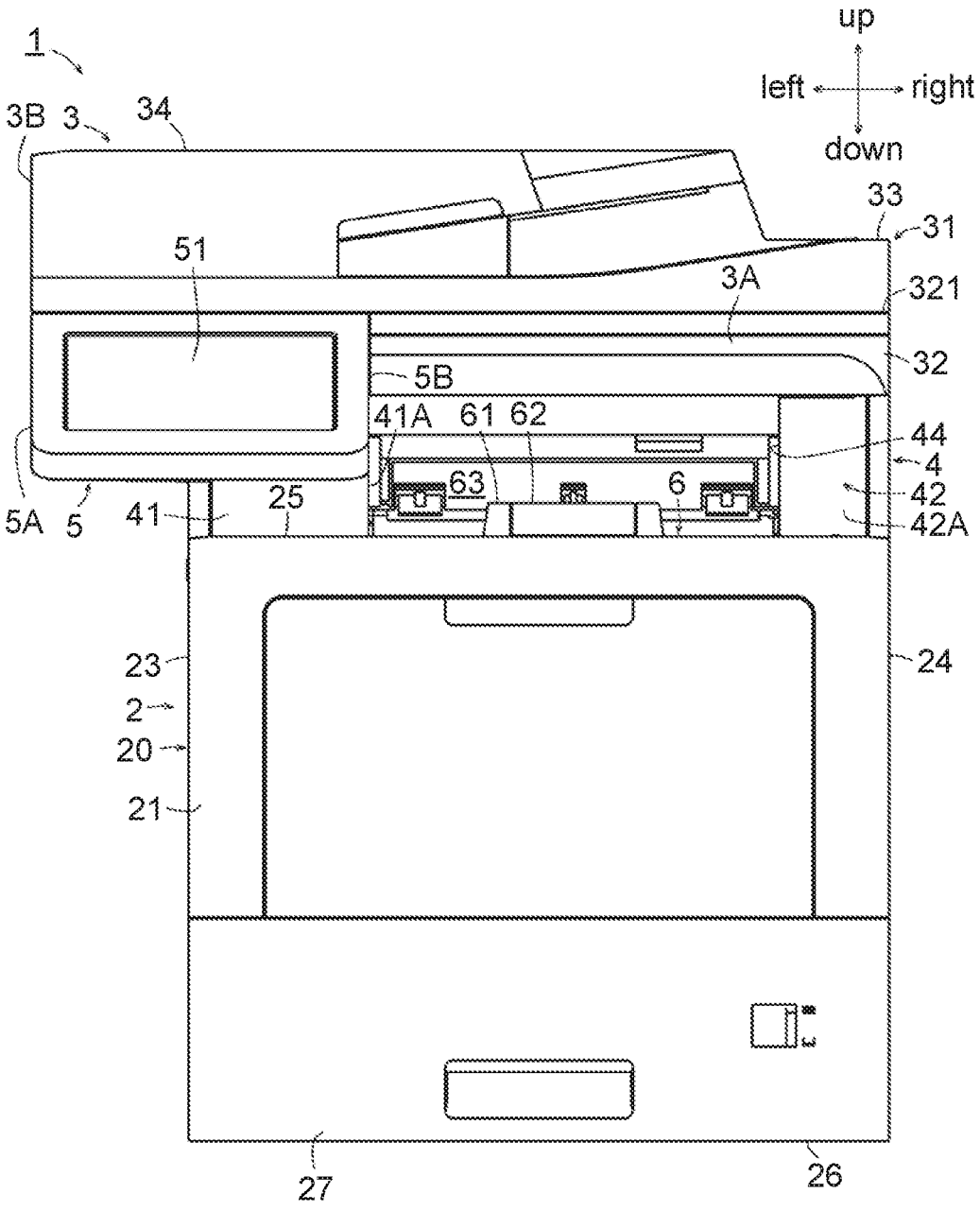
FIG. 2 is a front view of an image forming apparatus according to an illustrative embodiment of the disclosure.
Figure 3:
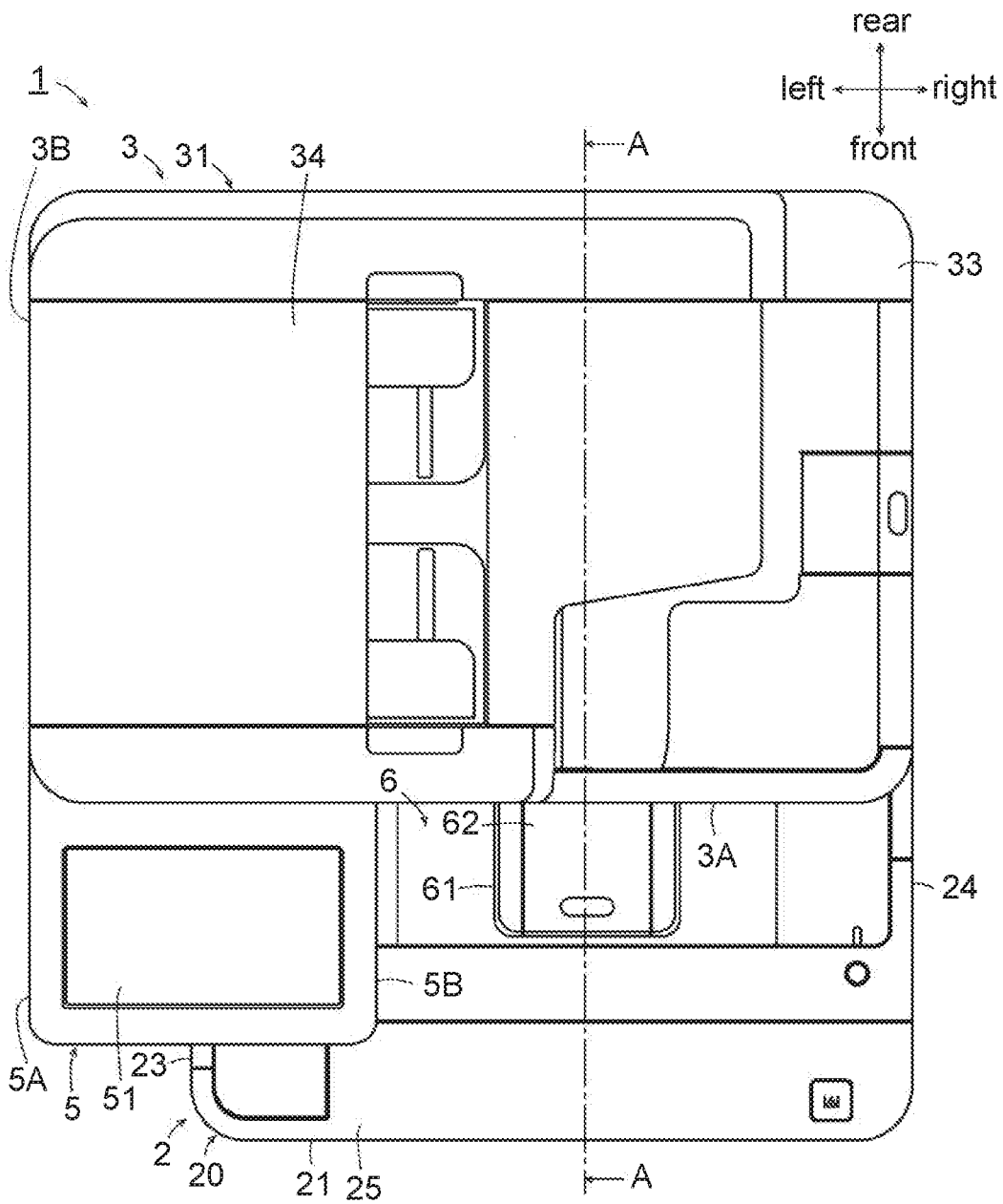
FIG. 3 is a plane view of an image forming apparatus according to an illustrative embodiment of the disclosure.
Figure 4:
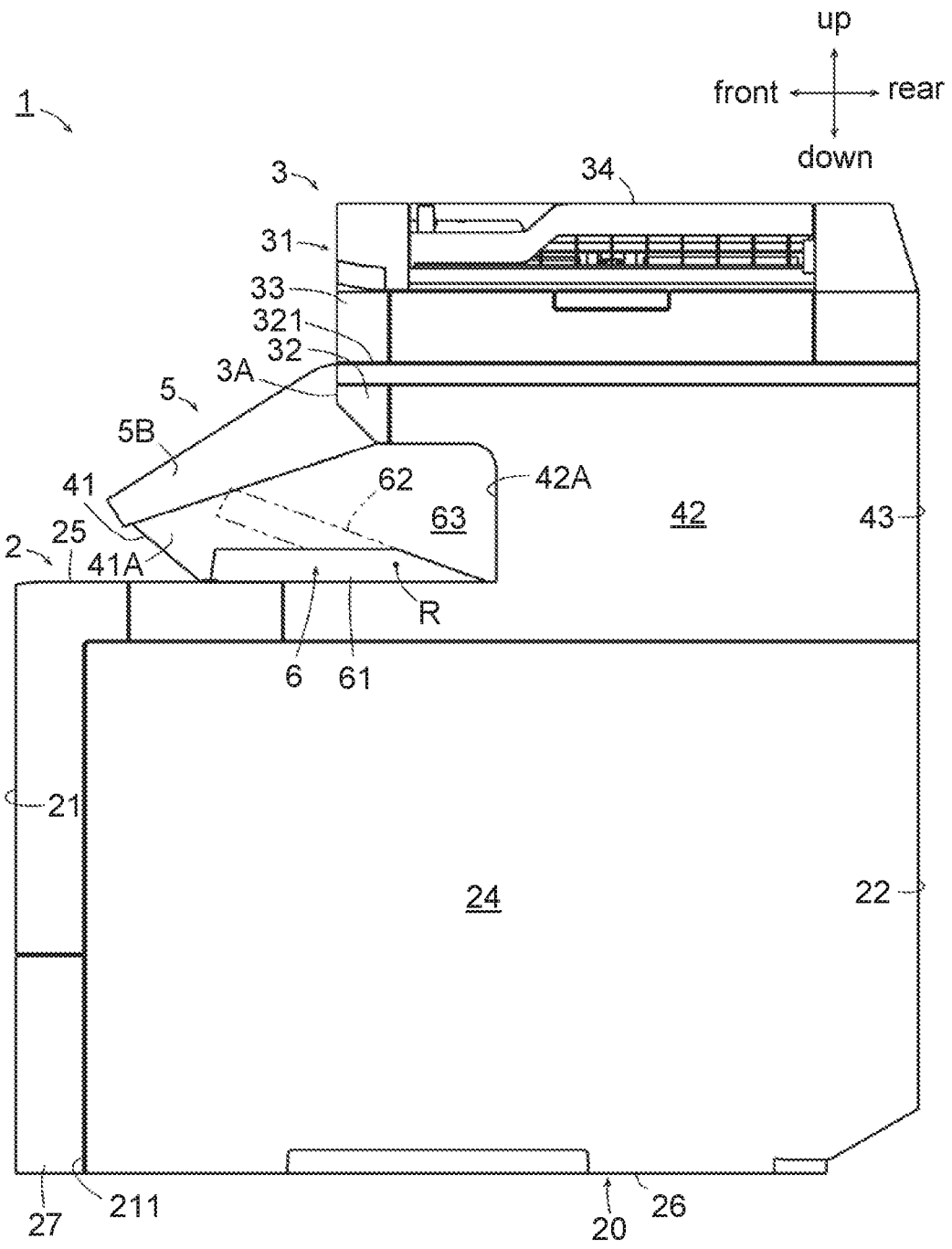
FIG. 4 is a right side view of an image forming apparatus according to an illustrative embodiment of the disclosure.
Figure 5:
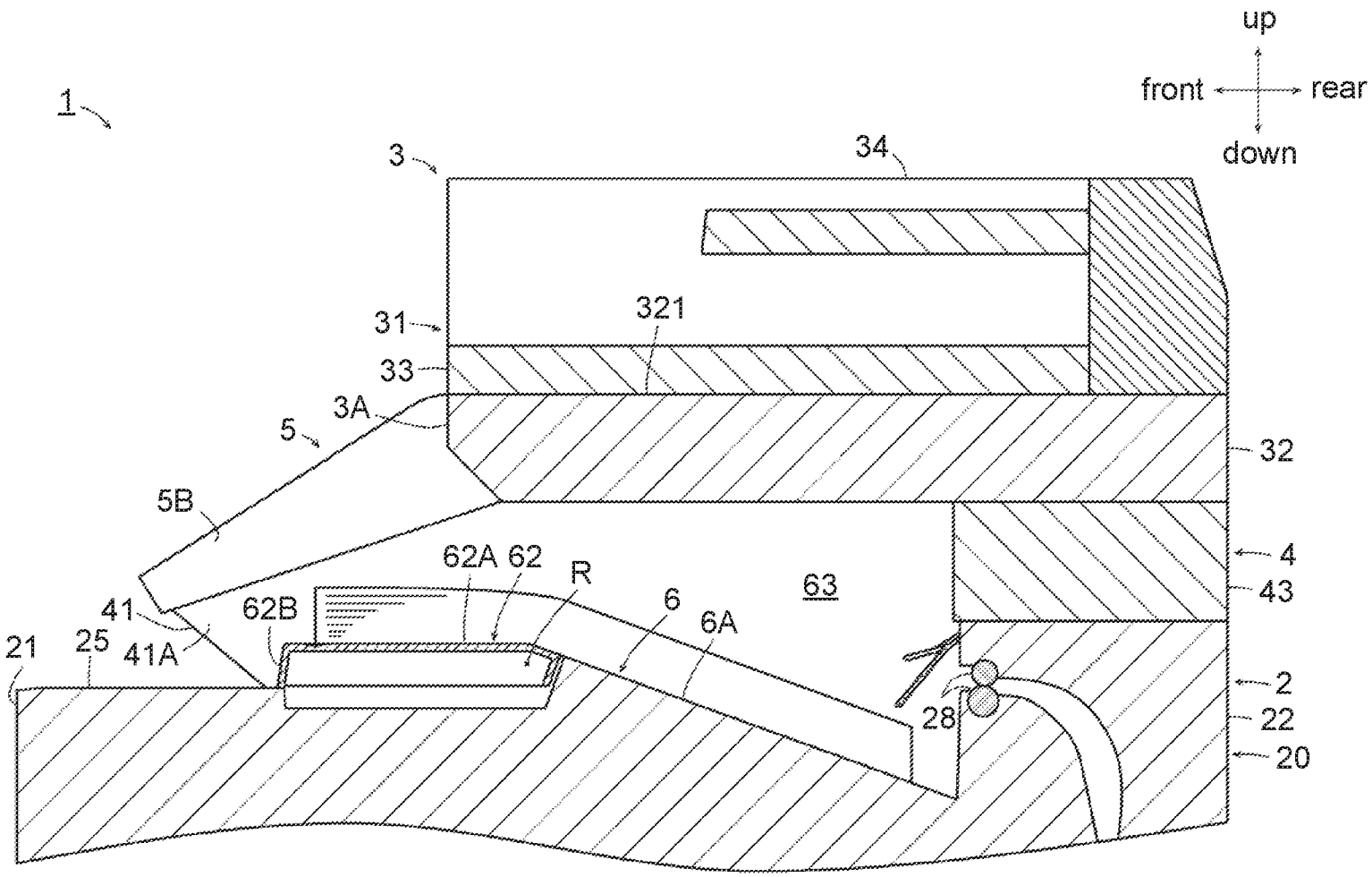
FIG. 5 is a sectional enlarged view taken along line A-A of FIG. 3 according to an illustrative embodiment of the disclosure.
Figure 6:
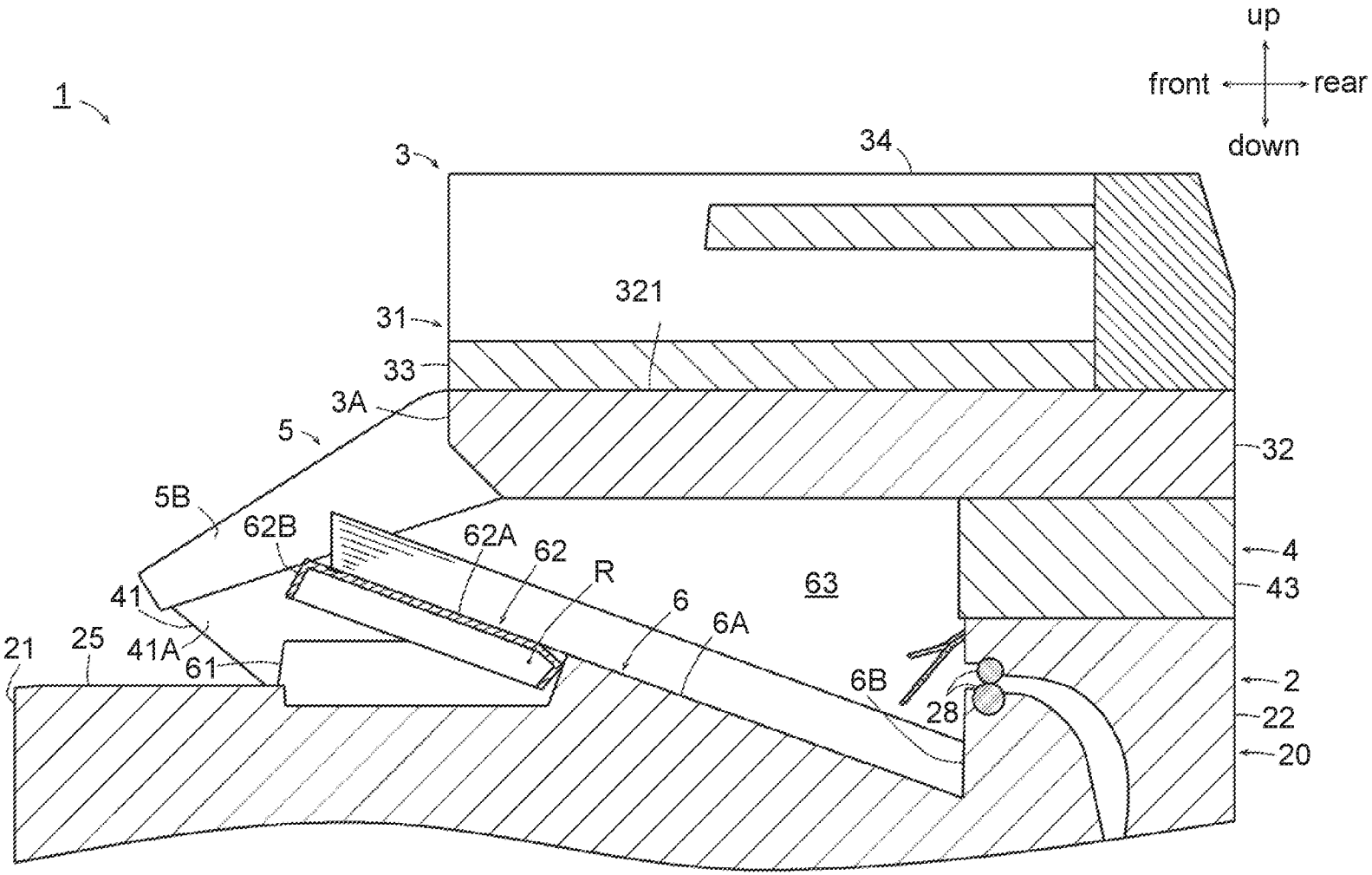
FIG. 6 illustrates a state in which a supporting member is in the used position in FIG. 5.

FIG. 1 is a perspective view of the image forming apparatus 1, FIG. 2 is a front view of the image forming apparatus 1, FIG. 3 is a plane view of the image forming apparatus 1 and FIG. 4 is a right side view of the image forming apparatus 1, according to an illustrative embodiment of the disclosure. FIG. 5 is a sectional enlarged view taken along line A-A of FIG. 3, and FIG. 6 illustrates a state in which a supporting member 62 is in the used position in FIG. 5. The image forming apparatus 1 has a configuration so-called "in-body discharge system". The image forming apparatus 1 includes a first housing 2, a second housing 3, a leg unit 4, and an operation panel 5.

As illustrated in FIG. 1, the first housing 2 includes a cover 20 having a substantially rectangular parallelepiped shape. The cover 20 includes a front surface 21, a rear surface 22, a left surface 23, a right surface 24, an upper surface 25, and a lower surface 26. The front surface 21 includes an opening 211 at a lower part of the front surface 21.

The first housing 2 accommodates a sheet tray 27, a conveying mechanism, an image forming unit, and a discharging mechanism. The sheet tray 27 is configured to support sheets and to be inserted to and removed from the first housing 2 through the opening 211. The conveying mechanism conveys a sheet from the sheet tray 27. The image forming unit forms an image on the sheet conveyed by the conveying mechanism. The discharging mechanism includes a discharging roller 28 for discharging the sheet from the image forming unit toward outside of the first housing 2. The discharging roller 28 is disposed around the downstream end of the discharging mechanism in a conveying direction of the sheet.

The sheet tray 27 is movable between an accommodated position shown in FIG. 1 and a withdrawal position. The sheet tray 27 is located at the accommodated position after inserted into the first housing 2 through the opening 211. The sheet tray 27 is located at the withdrawal position after withdrawn forward from the first housing 2 through the opening 211. The mechanism of the image forming unit may be an electrophotographic mechanism, inkjet mechanism or a thermal head mechanism.

On the upper surface 25 of the first housing 2, a discharging tray 6 for supporting sheets discharged by the discharging mechanism is disposed. The discharging tray 6 may be attached on the upper surface 25. Alternatively, the discharging tray 6 may be a part of the upper surface 25. The discharging tray 6 includes an inclined surface 6A, as shown in FIG. 6, which inclines upward from rear to front in the sheet discharging direction. Accordingly, the sheet with a formed image is discharged to the discharging tray 6 by the discharging mechanism while moving from the rear to the front.

As illustrated in FIG. 1, the second housing 3 is disposed above the first housing 2, and includes a document reading device 31. An upper surface of the document reading device 31 is a document table 321. The document reading device 31 includes a housing 32 accommodating an image reading unit for reading an image on the document placed on the document table 321. The document reading device 31 is further includes a document hold 33 disposed above the housing 32. The document hold 33 is pivotable between a closed position and an opened position about the rotation axis at a rear end portion of the second housing 3. The document hold 33 at the closed position is located over the document table 321. The document hold 33 at the opened position exposes the document table 321. The document reading device 31 further includes an auto document feeder 34 (hereinafter referred to as "ADF") above the document hold 33. The ADF is configured to convey the document automatically to the document table 321 and then to a tray on which the document is discharged.

The leg unit 4 includes a left leg member 41, a right leg member 42, and a rear leg member 43. The left leg member 41 is disposed at left end portion on the upper surface of the first housing 2. The right leg member 42 is disposed at right end portion on the upper surface of the first housing 2. The rear leg member 43 is disposed at rear end portion on the upper surface of the first housing 2. Each of the left leg member 41, the right leg member 42, and the rear leg member 43 has a certain length to support the second housing 3 for making a discharging space 63 between the second housing 3 and the discharging tray 6 of the first housing 2.

The left leg member 41, the right leg member 42, the upper surface of the first housing 2, and the lower surface of the second housing 3 form an opening 44 at front side of the image forming apparatus 1. The discharging space 63 is opened toward front side and right side through the opening 44. Accordingly, the user may take the sheet on the discharging tray 6 through the opening 44 from the front side or the right side of the image forming apparatus 1.

The discharging tray 6 includes a protrusion member 61, protruding upward from the inclined surface 6A, disposed at or adjacent a center of the discharging tray 6 in the width direction. The protrusion member 61 is trapezoid-shaped which inclines downward toward the rear side. The protrusion member 61 supports a supporting member 62, substantially rectangle and plate-shaped, such that rear end of the supporting member 62 is pivotable relative to the protrusion member 61 about a rotation axis R shown in FIG. 4 extending in the width direction. The supporting member 62 is disposed in the discharging space 63.

The supporting member 62 may suppress potential uplifted curl at both ends of the discharged sheet in the width direction because a center area of the discharged sheet in the width direction is on the support member 62. The discharged sheet on the support member 62 may make a space, around the protrusion member 61 under the discharged sheet, to which the user may easily access to grab the discharged sheet.

The supporting member 62 is configured to pivot between a retracted position and an upright position. The supporting member 62 at the retracted position extends substantially horizontally along a top end of the protrusion member 61. The supporting member 62 includes a front end 62B configured to rise as the supporting member 62 pivots from the retracted position to the upright position. The front end 62 of the supporting member 62 is configured to rise due to an upward urging force. The retracted position is an example of a "first position". The upright position is an example of a "second position". The supporting member 62 incorporates a spring therein (omitted in the drawings). Nevertheless, another embodiment may not have the supporting member 62 pivotable, and may alternatively have a fixed supporting member at the upright position.

As shown in FIG. 6, the supporting member 62 includes an upper surface 62A extending along the inclined surface 6A of the discharging tray 6 in a state where the supporting member 62 is at the upright position. Accordingly, the discharged sheets may receive a force to cause the sheets slid down rearward while supported on the inclined surface 6A and the upper surface 62A, such that the discharged sheets abut a wall surface 6B, which is rear end portion of the discharging tray 6, and are aligned.

As illustrated in FIG. 4, the rotation axis R is located further to the rear than a front end portion 3A of the second housing 3. That is, the front end portion 62B of the supporting member 62 is located at front side relative to the front end portion 3A of the second housing 3. Accordingly, a user may properly access the front end portion 62B of the supporting member 62 to pivot the supporting member 62 from the retracted position to the upright position.

Further, at least a part of sheet on the front end portion 62B of the supporting member 62 is visible when viewed down from above of the image forming apparatus 1 such that the user may easily access the sheet to take it out.

The right leg member 42 includes a front end surface 42A disposed further to the rear than the front surface 21, which is the front end portion of the first housing 2, and the front end portion 3A of the second housing 3. Accordingly, right side of the discharging space 63 is opened widely, thereby the user may easily access the discharging space 63 from the right side to take the sheet on the supporting member 62. The front end portion 3A of the second housing 3 is disposed further to the rear than the front surface 21 of the first housing 2. Accordingly, at least a part of the upper side of the discharging space 63 is opened, thereby the user may easily access the discharging space from the upper side to take the sheet on the supporting member 62.

As illustrated in FIG. 4, the height of the front end portion 62B of the supporting member 62 at the upright position, i.e., chain double-dashed line in FIG. 4, is substantially within a height range in which the front end surface 42A of the right leg member 42 extends vertically. Thus, the user may take the sheet on the supporting member 62 easily.

As illustrated in FIG. 2, the operation panel 5 has a shape that is substantially rectangular parallelepiped. The operation panel 5 has a length, in the width direction, that is equal to or less than a half length of the second housing 3 in the width direction. The operation panel 5 extends from the front end portion 3A of the second housing 3 toward downstream in the sheet discharging direction. The operation panel 5 includes a left side surface 5A that forms an aligned surface with a left side surface 3B of the second housing 3. The operation panel 5 includes a right side surface 5B that forms an aligned surface with the left leg member 41. Totally, the operation panel 5 is disposed at a separate location away from the discharging tray 6 in the width direction and is disposed above the discharging tray 6.

The operation panel 5 includes a display (e.g., liquid-crystal display) with a touchscreen function for operating the image forming unit and the image reading unit. In this embodiment, an operation screen 51 is disposed at upper surface of the operation panel 5 for the user's operation. Nevertheless, in other embodiments, the operation panel 5 may include physical buttons.

(Positional Relationship Between the Supporting Member and the Operation Panel)

As illustrated in FIG. 6, in a state where the supporting member 62 is at the upright position, at least a part of the front end portion 62B of the supporting member 62 overlaps the operation panel 5 when viewed in the width direction. Accordingly, front end portion of the discharged sheet is located on the front end portion 62B which is risen as the supporting member 62 is positioned at the upright position such that the sheet reaches substantially the same height as the operation panel 5. Therefore, after operating the operation panel, the user may just need to slide his/her hand in the width direction for taking the discharged sheet on the discharging tray 6. Therefore, both the accessibility to the operation panel 5 and the accessibility to the discharged sheets on the discharging tray 6 subsequent to the operation for the operation panel 5 may be enhanced.

(Positional Relationship Between the Operation Panel and the Discharging Tray)

The right side surface 5B of the operation panel 5 aligns with the right side surface 41A of the left leg member 41. That is, the right side surface 5B of the operation panel 5 is along the left end of the discharging tray 6. Accordingly, the right side surface 5B of the operation panel 5 in the width direction is configured to guide the left end of the sheet on the supporting member 62. Thus, each sheet discharged to the discharging tray 6 is aligned in the width direction without an additional guide.

The operation panel 5 is fixed to the second housing 3. The fixed operation panel 5 may help the positional relationship between the operation panel 5 and the supporting member 62 maintain. The operation panel 5 may also guide the sheet.

(Modification)

Figure 7:
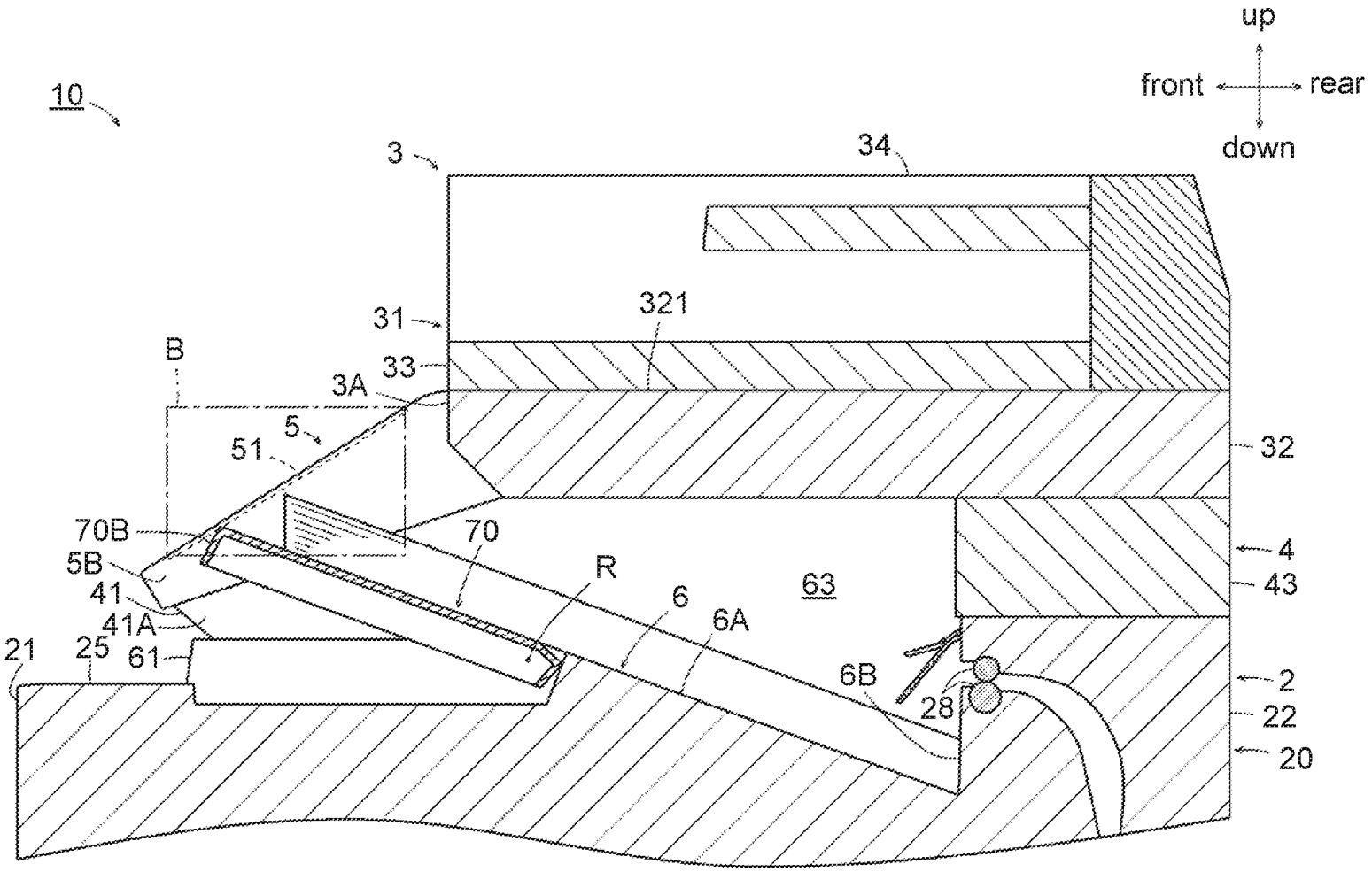
FIG. 7 is a sectional enlarged view of an image forming apparatus according to a variation of the disclosure.

FIG. 7 is a sectional enlarged view of an image forming apparatus 10 according to the modified embodiment. The image forming apparatus 10 shown in FIG. 7 includes a supporting member 70 instead of the supporting member 62 of the image forming apparatus 1. The other elements of the image forming apparatus 10 may be identical or similar to the image forming apparatus 1. Hereinafter, the difference between the image forming apparatus 1 and the image forming apparatus 10 are described. The configurations which may be identical or similar to those of the image forming apparatus 1 are described with the same reference numeral without detail description.

In this modified embodiment, in a state where the supporting member 70 is at the upright position, the front end portion 70B of the supporting member 70 overlaps the operation screen 51 when viewed in the width direction as illustrated in FIG. 7. In general, the supporting member 70 may be disposed such that at least a part of the supporting member 70 overlaps a virtual quadrangle area B of which the operation screen 51 of the operation panel 5 consists a diagonal line. The "virtual quadrangle area" means an area including both of frame and inside thereof. The supporting member 70 may extend longer or shorter as far as the front end portion 70B of the supporting member 70 at the upright position is located within the virtual quadrangle area B when viewed in the width direction as illustrated in FIG. 7. Further, the operation screen 51 may be horizontally disposed such that the front end portion 70B of the supporting member 70 at the upright position crosses the operation screen 51 when viewed in the width direction as illustrated in FIG. 7. The shape of the virtual quadrangle area B may be rectangle such that the position of the front end portion 70B of the supporting member 70 at the upright position may be determined easily.

Accordingly, front end portion of the discharged sheet is located on the front end portion 70B which is risen as the supporting member 70 is positioned at the upright position such that the sheet reaches substantially the same height as the operation panel 5 as in the image forming apparatus 1. Accordingly, the image forming apparatus 10 may reach similar achievement to what the image forming apparatus 1 reaches.

What is claimed is:

1. An image forming apparatus comprising:

a discharging tray configured to support a sheet, the sheet being discharged toward a sheet discharging direction, the sheet discharging direction being a direction toward which the sheet is discharged;

an operation panel configured to be located at a position that is different from the position of the discharging tray in a width direction, which is orthogonal with respect to the sheet discharging direction and with respect to a vertical direction, and above the discharging tray; and a supporting member configured to be located at the discharging tray, the supporting member being capable of supporting the discharged sheet with the discharging tray, and a front end portion of the supporting member configured to be located above an upper surface of the discharging tray, wherein a distal end of the front end portion of the supporting member is configured to overlap the operation panel when viewed in the width direction, and wherein the operation panel is configured to be located at a position that is different from the position of the supporting member in the width direction, and wherein one side of the operation panel in the width direction is configured to guide one end of the sheet in the width direction supported by the supporting member.

2. The image forming apparatus according to claim 1, further comprising:

a first housing on which the discharging tray is configured to be disposed and which is configured to accommodate an image forming unit for forming an image on the sheet;

a second housing which is configured to be located above the first housing and which is configured to accommodate an image reading unit for reading an image in a document; and a plurality of leg members configured to be located on an upper surface of the first housing, each of the plurality of leg members configured to support the second housing by being separated from each other, wherein a front end portion of the supporting member is configured to be located downstream, in the sheet discharging direction, of a downstream end of the second housing in the sheet discharging direction.

3. The image forming apparatus according to claim 2, wherein the plurality of leg members includes a first leg member configured to be located at opposite side of the operation panel in the width direction, and wherein the downstream end of the first leg member in the sheet discharging direction configured to be located upstream, in the sheet discharging direction, of both of downstream end of the first housing in the sheet discharging direction and the downstream end of the second housing in the sheet discharging direction.

4. The image forming apparatus according to claim 3, wherein a height of the front end portion of the supporting member is within a height range of the downstream end of the first leg member in the sheet discharging direction.

5. The image forming apparatus according to claim 2, wherein the supporting member is capable of pivoting between a first position and a second position about a rotation axis extending the width direction, the front end portion of the supporting member at the second position locating above the front end portion of the supporting member at the first position, and wherein at least a part of the front end portion of the supporting member at the second position is configured to overlap the operation panel when viewed in the width direction.

6. The image forming apparatus according to claim 5, wherein the rotation axis for rotating the supporting member is configured to be located upstream, in the sheet discharging direction, of downstream end of the second housing in the sheet discharging direction.

7. The image forming apparatus according to claim 5, wherein the discharging tray includes an inclined surface which inclines upward from rear side to front side toward downstream in the sheet discharging direction, and wherein a top surface of the supporting member at the second position is along the inclined surface.

8. The image forming apparatus according to claim 2, wherein the operation panel is fixed to the second housing.

9. The image forming apparatus according to claim 1, further comprising:

a first housing having an upper surface on which the discharging tray is disposed;

a second housing, located above the first housing, including the operation panel; and a plurality of leg members, each being located between the first housing and the second housing, thereby forming a space between the first housing and the second housing, wherein the supporting member is located in the space.

10. The image forming apparatus according to claim 1, wherein the operation panel includes an operation screen disposed at an upper surface of the operation panel.

11. The image forming apparatus according to claim 1, wherein the operation panel includes a display with a touchscreen for operating the image forming apparatus.

12. An image forming apparatus comprising:

a discharging tray configured to support a sheet, the sheet being discharged toward a sheet discharging direction, the sheet discharging direction being a direction toward which the sheet is discharged;

an operation panel configured to be located at a position that is different from the position of the discharging tray in a width direction, which is orthogonal with respect to the sheet discharging direction and with respect to a vertical direction, and above the discharging tray, the operation panel including an operation screen; and a supporting member configured to be disposed at the discharging tray, the supporting member being capable of supporting the discharged sheet with the discharging tray, and a front end portion of the supporting member configured to be located above an upper surface of the discharging tray, wherein a distal end of a front end portion of the supporting member is configured to overlap a quadrangle area when viewed in the width direction, the operation screen in the operation panel consisting of a diagonal line of a rectangle area, and wherein the operation panel is configured to be located at a position that is different from the position of the supporting member in the width direction.

13. The image forming apparatus according to claim 12, wherein the operation screen is disposed at an upper surface of the operation panel.

14. The image forming apparatus according to claim 12, wherein the operation screen is a touchscreen for operating the image forming apparatus.

15. An image forming apparatus comprising:

a discharging tray extending in a sheet discharging direction perpendicular to a width direction, which is orthogonal with respect to the sheet discharging direction and with respect to a vertical direction;

an operation panel located above the discharging tray at a position away from the discharging tray in the width direction; and a supporting member, disposed on the discharging tray, including a front end portion inclined upwardly in the sheet discharging direction, wherein a distal end of the front end portion of the supporting member overlaps the operation panel when viewed in the width direction, and wherein the operation panel is configured to be located at a position that is different from the position of the supporting member in the width direction.

16. The image forming apparatus according to claim 15, wherein the discharging tray further includes an inclined surface inclined upwardly in the sheet discharging direction, and wherein the supporting member further includes an upper surface extending along the inclined surface.

17. The image forming apparatus according to claim 15, wherein the operation panel includes an operation screen disposed at an upper surface of the operation panel.

18. The image forming apparatus according to claim 15, wherein the operation panel includes a display with a touchscreen for operating the image forming apparatus.

19. An image forming apparatus comprising:

a discharging tray configured to support a sheet, the sheet being discharged toward a sheet discharging direction, the sheet discharging direction being a direction toward which the sheet is discharged;

an operation panel configured to be located at a position that is different from the position of the discharging tray in a width direction, which is orthogonal with respect to the sheet discharging direction and with respect to a vertical direction, and above the discharging tray;

a supporting member configured to be located at the discharging tray, the supporting member being capable of supporting the discharged sheet with the discharging tray, and a front end portion of the supporting member configured to be located above an upper surface of the discharging tray;

a first housing on which the discharging tray is configured to be disposed and which is configured to accommodate an image forming unit for forming an image on the sheet;

a second housing which is configured to be located above the first housing and which is configured to accommodate an image reading unit for reading an image in a document; and a plurality of leg members configured to be located on an upper surface of the first housing, each of the plurality of leg members configured to support the second housing by being separated from each other, wherein a front end portion of the supporting member is configured to be located downstream, in the sheet discharging direction, of a downstream end of the second housing in the sheet discharging direction, wherein at least a part of the front end portion of the supporting member is configured to overlap the operation panel when viewed in the width direction, wherein the operation panel is configured to be located at a position that is different from the position of the supporting member in the width direction, and wherein the operation panel includes an operation screen.

20. An image forming apparatus comprising:

a discharging tray configured to support a sheet, the sheet being discharged toward a sheet discharging direction, the sheet discharging direction being a direction toward which the sheet is discharged;

an operation panel configured to be located at a position that is different from the position of the discharging tray in a width direction, which is orthogonal with respect to the sheet discharging direction and with respect to a vertical direction, and above the discharging tray, the operation panel including an operation screen;

a supporting member configured to be disposed at the discharging tray, the supporting member being capable of supporting the discharged sheet with the discharging tray, and a front end portion of the supporting member configured to be located above an upper surface of the discharging tray;

a first housing on which the discharging tray is configured to be disposed and which is configured to accommodate an image forming unit for forming an image on the sheet;

a second housing which is configured to be located above the first housing and which is configured to accommodate an image reading unit for reading an image in a document; and a plurality of leg members configured to be located on an upper surface of the first housing, each of the plurality of leg members configured to support the second housing by being separated from each other, wherein a front end portion of the supporting member is configured to be located downstream, in the sheet discharging direction, of a downstream end of the second housing in the sheet discharging direction, wherein at least a part of the supporting member configured to overlap a quadrangle area when viewed in the width direction, the operation screen in the operation panel consisting a diagonal line of a rectangle area, and wherein the operation panel is configured to be located at a position that is different from the position of the supporting member in the width direction.

21. An image forming apparatus comprising:

a discharging tray extending in a sheet discharging direction perpendicular to a width direction, which is orthogonal with respect to the sheet discharging direction and with respect to a vertical direction;

an operation panel located above the discharging tray at a position away from the discharging tray in the width direction;

a supporting member, disposed on the discharging tray, including a front end portion inclined upwardly in the sheet discharging direction;

a first housing on which the discharging tray is configured to be disposed and which is configured to accommodate an image forming unit for forming an image on the sheet;

a second housing which is configured to be located above the first housing and which is configured to accommodate an image reading unit for reading an image in a document; and a plurality of leg members configured to be located on an upper surface of the first housing, each of the plurality of leg members configured to support the second housing by being separated from each other, wherein a front end portion of the supporting member is configured to be located downstream, in the sheet discharging direction, of a downstream end of the second housing in the sheet discharging direction, wherein the front end portion of the supporting member overlaps the operation panel when viewed in the width direction, wherein the operation panel is configured to be located at a position that is different from the position of the supporting member in the width direction, and wherein the operation panel includes an operation screen.

* * * * *